US007013550B2

(12) United States Patent
Shinjo

(10) Patent No.: US 7,013,550 B2
(45) Date of Patent: Mar. 21, 2006

(54) METHOD OF MAKING SELF-PIERCING NUTS

(75) Inventor: Tadashi Shinjo, Sakai (JP)

(73) Assignee: Yugenkaisha Shinjo Seisakusho, Osaka (JP)

( * ) Notice: Subject to any disclaimer, the term of this patent is extended or adjusted under 35 U.S.C. 154(b) by 0 days.

(21) Appl. No.: 10/819,289

(22) Filed: Apr. 7, 2004

(65) Prior Publication Data

US 2004/0226161 A1 Nov. 18, 2004

(30) Foreign Application Priority Data

May 12, 2003 (JP) ..... 2003-132461

(51) Int. Cl.
*B23P 13/04* (2006.01)

(52) U.S. Cl. ..... 29/558; 29/432.2; 29/557; 470/25; 72/377; 411/179

(58) Field of Classification Search ..... 29/557, 29/558, 432.2, 788; 470/21, 25; 72/377; 411/179, 180, 967

See application file for complete search history.

(56) References Cited

U.S. PATENT DOCUMENTS 1,852,978 A * 4/1932 Mitchel ..... 411/180
2,057,527 A * 10/1936 Johnson ..... 470/21
2,127,696 A * 8/1938 Mitchel ..... 411/177
2,170,290 A * 8/1939 Renner ..... 470/20
2,254,644 A * 9/1941 Cousino ..... 470/89
2,279,574 A * 4/1942 Langmaid ..... 411/172
2,281,699 A * 5/1942 Langmaid et al. ..... 411/183
2,310,316 A * 2/1943 Renner ..... 470/21
2,707,372 A 5/1955 Cleveland, II
3,152,628 A 10/1964 Strain et al.
3,704,507 A * 12/1972 Grube ..... 29/417
3,793,658 A * 2/1974 Ladouceur ..... 470/21
3,883,915 A * 5/1975 Steward ..... 470/25
4,299,000 A * 11/1981 Koch ..... 470/25
5,531,552 A * 7/1996 Takahashi et al. ..... 411/179
5,618,237 A * 4/1997 Shinjo ..... 470/91
5,927,920 A * 7/1999 Swanstrom ..... 411/180

(Continued)

FOREIGN PATENT DOCUMENTS

JP 07171654 A * 7/1995

(Continued)

*Primary Examiner*—Essama Omgba
(74) *Attorney, Agent, or Firm*—Antonelli, Terry, Stout and Kraus, LLP.

(57) ABSTRACT

A raw parallelepiped metal piece is pressed into a closed mold to provide a nut blank that has a generally square pilot portion (14) for piercing a metal panel, the nut blank having a pair of flanges (16) that continue from opposite side walls (15) of the pilot portion. Then, the nut blank is coined to form ridges (20) extending along and integral with opposite upper edges of the side walls (15), before pressed within an open mold so that the ridges are swaged out sideways to form shoulders (21). A lateral groove (22) is defined between below each shoulder and in the side wall. A rough bore (23) will be formed axially through the pilot portion (14), before tapped to have a female thread (24) in the inner periphery of the bore.

2 Claims, 7 Drawing Sheets

U.S. PATENT DOCUMENTS

| | | | | |
|---|---|---|---|---|
| 6,257,814 | B1 * | 7/2001 | Muller | 411/176 |
| 6,439,819 | B1 * | 8/2002 | Swanstrom et al. | 411/437 |
| 6,543,979 | B1 * | 4/2003 | Iwatsuki | 411/180 |
| 6,851,904 | B1 * | 2/2005 | Parker et al. | 411/180 |
| 6,893,354 | B1 * | 5/2005 | Feng-Long | 470/23 |
| 2001/0031188 | A1 * | 10/2001 | Iwatsuki | 411/180 |
| 2004/0042871 | A1 * | 3/2004 | Wojciechowski et al. | 411/181 |
| 2004/0087381 | A1 * | 5/2004 | Ward et al. | 470/25 |
| 2004/0192452 | A1 * | 9/2004 | Brun | 470/25 |
| 2004/0234357 | A1 * | 11/2004 | Wojciechowski et al. | 411/181 |
| 2005/0103086 | A1 * | 5/2005 | Wojciechowski et al. | 72/377 |

FOREIGN PATENT DOCUMENTS

| | | | |
|---|---|---|---|
| WO | WO 2004050269 | A2 * | 6/2004 |

* cited by examiner

FIG. 7 (a) Prior Art
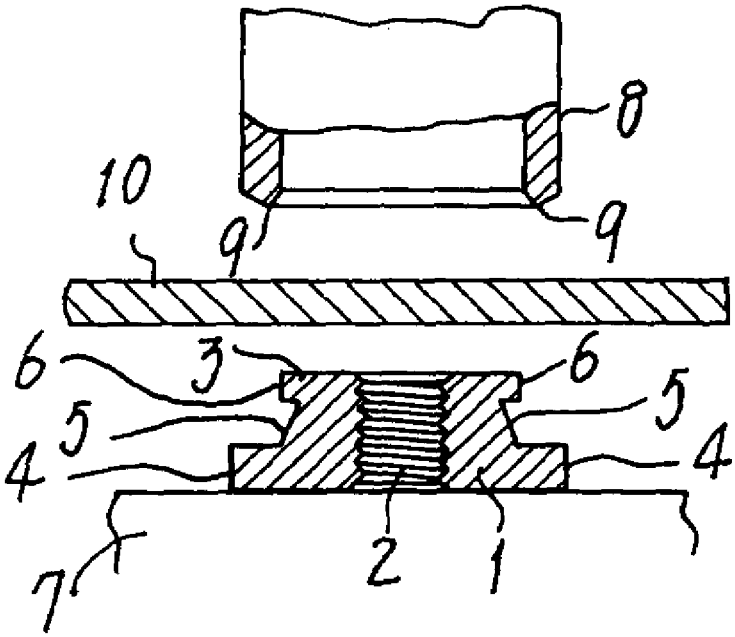
FIG. 7 (b) Prior Art
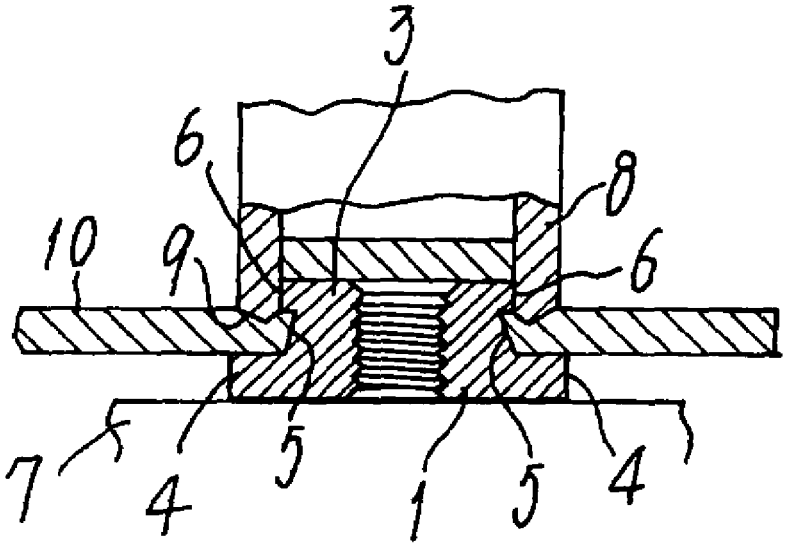

METHOD OF MAKING SELF-PIERCING NUTS

FIELD OF THE INVENTION

The present invention relates to a method of making the so-called self-piercing nuts, wherein each of them has a pilot portion formed in and protruding from one of opposite end faces so as to surround a threaded bore penetrating a nut body. This body of the self-piercing nut has to serve per se as a punch for punching a hole through a metal panel in such a manner that opposite regions of a closed and generally rectangular edge of the hole are caulked to bite and fix the nut in position. Such a fixing process takes place instantly and in an automatically clicking manner.

PRIOR ART

Some types of self-piercing nuts are known in the art, and one example is shown in the U.S. Pat. No. 2,707,372 or ibid. No. 3,152,628. Those nuts are of a rectangular configuration (usually called "universal type"), and they have the most basic structure adapted for use on a large scale in manufacture of automobile car parts.

FIGS. 7(*a*)and 7(*b*)illustrate the self-piercing nut of the prior art type, in which its nut body 1 is of a rectangular shape in plan view. This nut has a generally square pilot portion 3 formed around a central threaded bore 2, and this portion has a top face for punching a metal panel. Flanges 4 and 4 protrude sideways from and integrally with the bottom regions of opposite side walls of the pilot portion 3. These flanges 4 will function to secure the nut in and through metal panel and also to firmly hold in position a screw that will be tightened into the threaded bore 2. A pair of lateral grooves 5 and 5 facing away from each other do continue from the respective flanges 4 and 4 towards the top face of pilot portion 3. Edge regions of a punched hole penetrating the metal panel 10 will be caulked and forced into those lateral grooves 5. Shoulders 6 and 6 defining the upper ends of grooves 5 are made integral with the said top face of pilot portion 3 so as to extend in parallel with opposite side walls thereof. In use, the pilot portion 3 of this nut held on an anvil or the like 7 will cooperate with a caulking die 8 to punch a hole in the metal panel 10. Simultaneously with such a punching motion, a pair of caulking blades 9 and 9 of the die 8 do instantly force the opposite edge regions of punched hole into the grooves, as seen in FIG. 7(*b*). The shoulders 6 will thus firmly hook these edge regions so as to fix this self-piercing nut body I through the metal panel 10.

In general, the rectangular type self-piercing nuts shown in FIG. 7(*a*) have been manufactured using a raw and elongate material for forming a coiled spring. This material should preliminarily be processed to have a profiled cross section providing longitudinal grooves that correspond to the lateral grooves 5 and 5 in each pilot portion 3. Before or after severing the elongate material into pieces as the unfinished nuts, a rough hole must be opened in each piece subject to the tapping process. However, round starting rods have not necessarily been easy to roll or draw through a die in order to form such profiled elongate material. Thus, manufacture of the self-piercing nuts according to the prior art method has been much more expensive than in case of producing ordinary nuts.

SUMMARY OF THE INVENTION

An object of the present invention made in view of the drawbacks inherent in the prior art methods is therefore to provide a novel method of mass-producing the rectangular type self-piercing nuts in such a manner that any conventional nut-former can be used to inexpensively form lateral grooves in the opposite side walls of a pilot portion of each nut.

In order to achieve this object, a method proposed herein may comprise the step of firstly and preliminarily pressing into a closed mold a raw parallelepiped metal piece so as to provide a nut blank that has as an upper region thereof a generally square pilot portion capable of piercing a metal panel, the nut blank having as a lower region thereof a pair of flanges that continue sideways from opposite side walls of the pilot portion. The method further comprises the steps of secondly coining the nut blank to form a pair of ridges facing one another and extending along and integral with opposite upper edges of the pilot portion, and thirdly pressing the nut blank within an open mold so that the ridges are swaged sideways and outwards to form shoulders such that a lateral groove is formed in the side wall and intermediate between each shoulder and one of the flanges facing it. The method may further comprise the steps of fourthly boring a rough hole axially through the pilot portion, and finally tapping a female thread in the inner periphery of the rough hole.

Preferably, an upper and lower round recesses or countersinks may be formed centrally of the nut blank and simultaneously with the step of coining the nut blank. In this case, this coining step itself as well as, or rather, the later step of boring the rough hole will be facilitated to a considerable degree.

BRIEF DESCRIPTION OF THE DRAWINGS

FIG. 1(*b*) is an enlarged perspective view of the nut blank;

FIG. 2(*b*) is an enlarged perspective view of the nut blank thus preliminarily pressed;

FIG. 3(*b*) is an enlarged perspective view of the nut blank thus processed to have such ridges;

FIG. 4(*b*) is an enlarged perspective view of the nut blank thus processed to have such shoulders and grooves;

FIG. 5(*b*) is an enlarged perspective view of the nut blank thus processed to have such an unthreaded bore;

FIG. 6(*b*) is a front elevation of the self-piercing nut;

FIG. 7(*a*)is a front elevation of the prior art rectangular type self-piercing nut before attached to a metal panel; and FIG. 7(*b*)also is a front elevation of the prior art self-piercing nut after attached to the metal panel.

THE PREFERRED EMBODIMENTS

Now an embodiment of the present invention will be described referring to the accompanying drawings, in which FIGS. 1(*a*) to 5(*b*) show a nut bank that is being processed in an ordinary and widely used nut-former at the sequential steps for manufacturing a self-piercing nut.

Figure 1A:
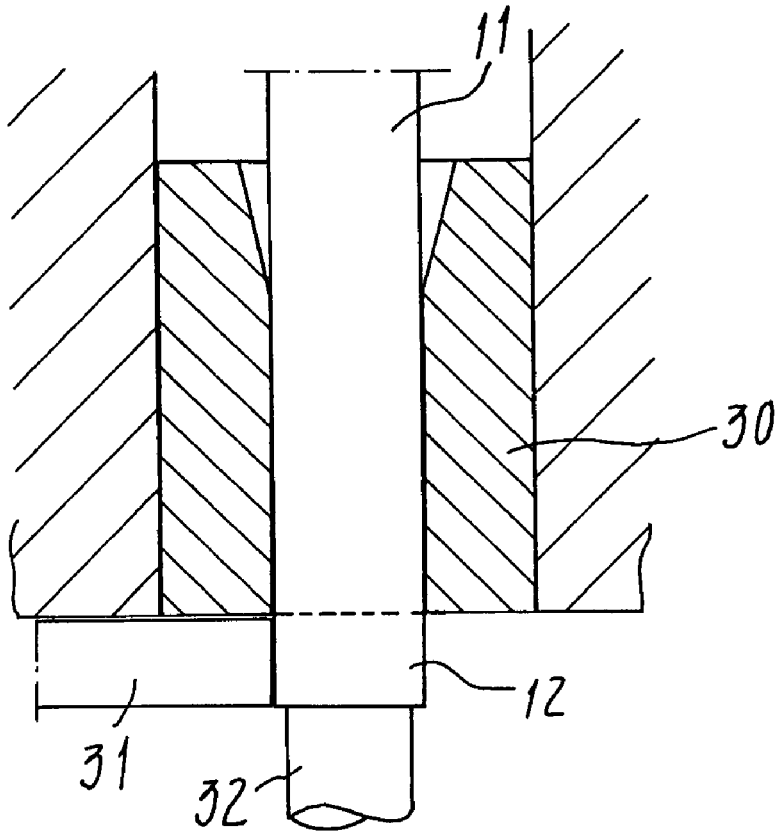
FIG. 1(*a*) is a vertical cross section of the apparatus being used in the present invention and severing a nut blank from a raw material.
Figure 1B:
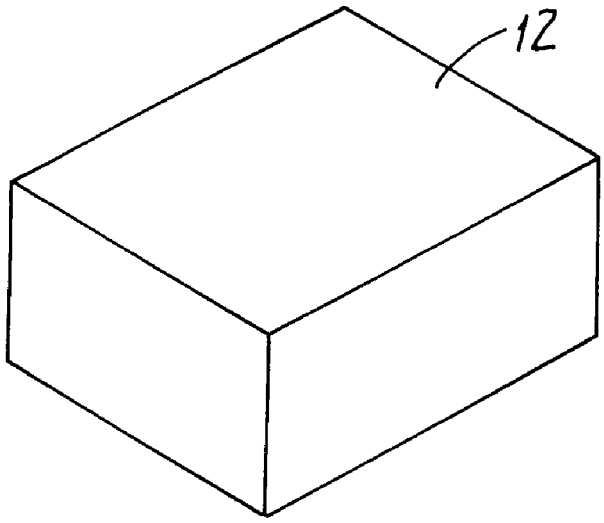

FIGS. 1(*a*) and 1(*b*) show the first step of preparing a raw nut blank 12 of a required cut length corresponding to a self-piercing nut. A low-carbon steel rod 11 usually forming a coiled spring is placed in this case in and through a quill 30, and then a knife 31 severs from the rod 11 the blank 12 of said length projected from the quill. The reference numeral 32 denotes a stopper for determination of a distance equal to the given length.

Figure 2:
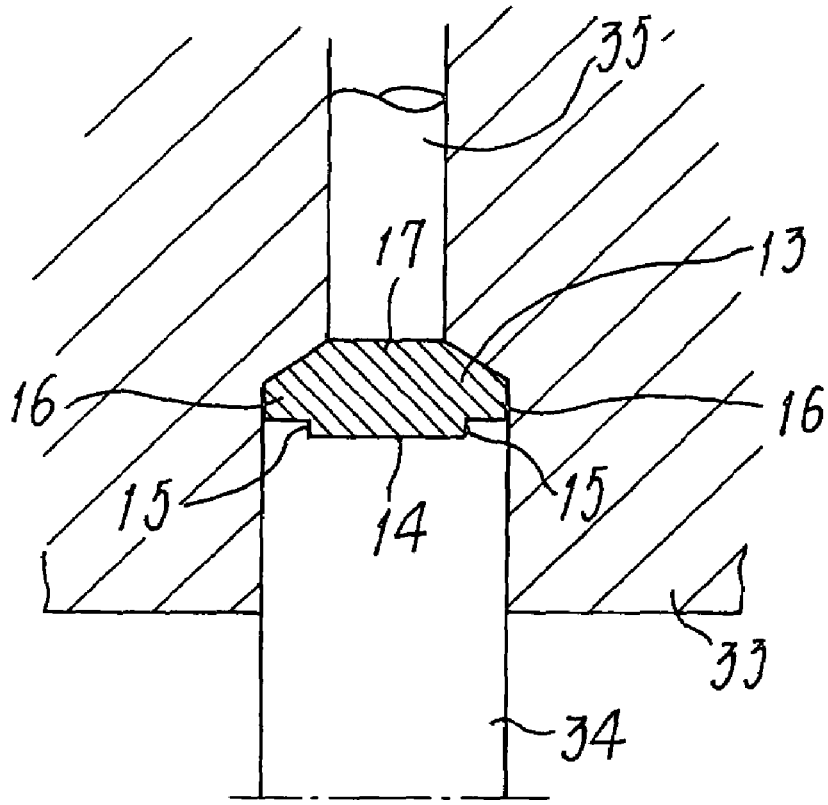
FIG. 2(*a*) is a vertical cross section of the apparatus being used to preliminarily press the nut blank to form therein a rough pilot portion.
Figure 2:
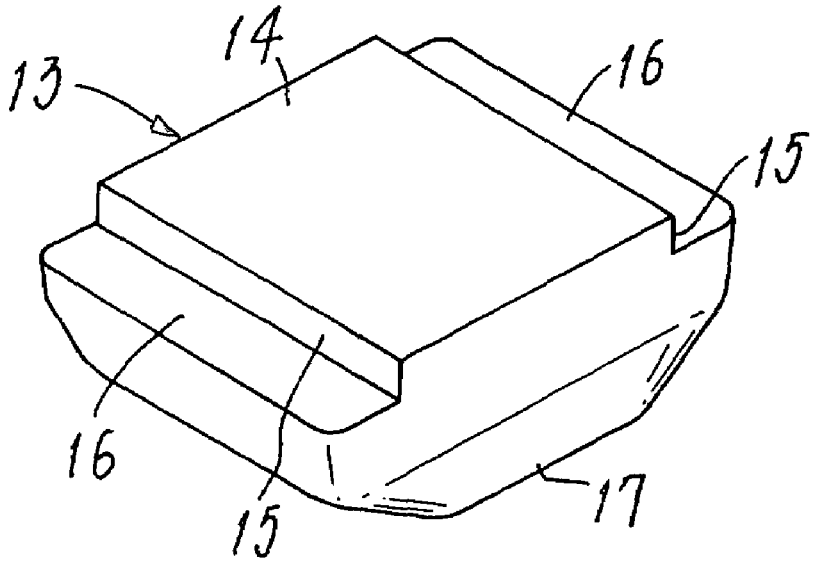

FIGS. 2(*a*) and 2(*b*) show the second step of preliminarily swaging the raw nut blank 12 within a closed mold. A punch 34 of this mold has pressed this blank into a die 33, so as to give an unfinished nut blank 13. The thus swaged nut blank 13 will have a rough pilot portion 14 and a pair of flanges 16. The pilot portion 14 has a generally square end face continuing to side walls 15, with the flanges 16 having top faces disposed a distance below that of said pilot portion. A bottom 17 (reversed upside down within the mold which FIG. 2(*a*) shows) of this nut blank 13 inclusive of the integral flanges 16 is shaped as a quadrangular frustum of pyramid. Such a frusto-pyramidal configuration facilitates the swaging process and enhances the dimensional accuracy of said blank 13. The further reference numeral 35 denotes a knocking-out punch.

Figure 3A:
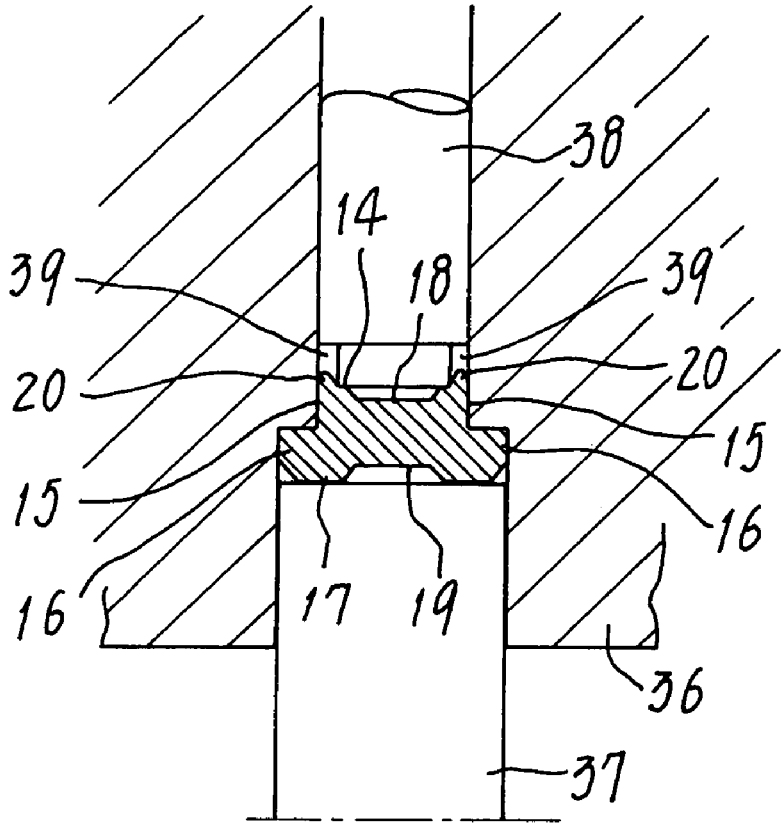
FIG. 3(*a*) also is a vertical cross section the apparatus being used further to form ridges in the pilot portion of nut blank.
Figure 3B:
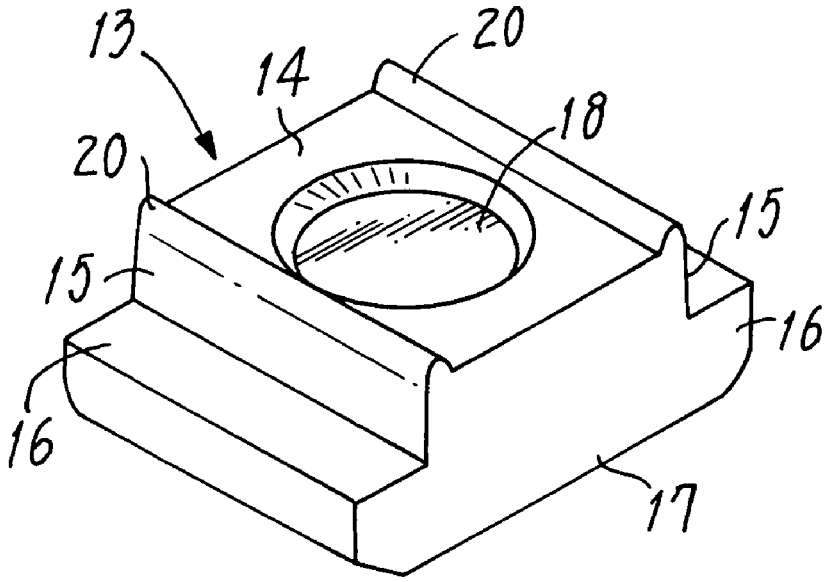

FIGS. 3(*a*) and 3(*b*) show the next step of further swaging the nut blank 13. Here will be formed a pair of ridges 20 integral with and protruding up from the upper edges of two opposite side walls 15 of the pilot portion 14. In detail, the nut blank 13 prepared at the preceding step will be turned upside down within a further die 36, before a pair of further punches 37 and 38 facing one another do press the blank gripped between them. Recesses 18 and 19 will thus be formed in and centrally of the top of pilot portion 14 and the bottom 17 of nut blank 13, respectively. These recesses 18 and 19 are disposed coaxial with each other to facilitate the later step of boring a rough hole to be threaded later. The upper edges of the facing side walls 15 of pilot portion 14 will be forced into the cavities or gaps 39, that are defined between the lower end part of punch 38 and the square periphery of die 36. Such upper edges squeezed into those gaps 39 are thus shaped to provide the pilot portion with the parallel ridges 20.

Figure 4:
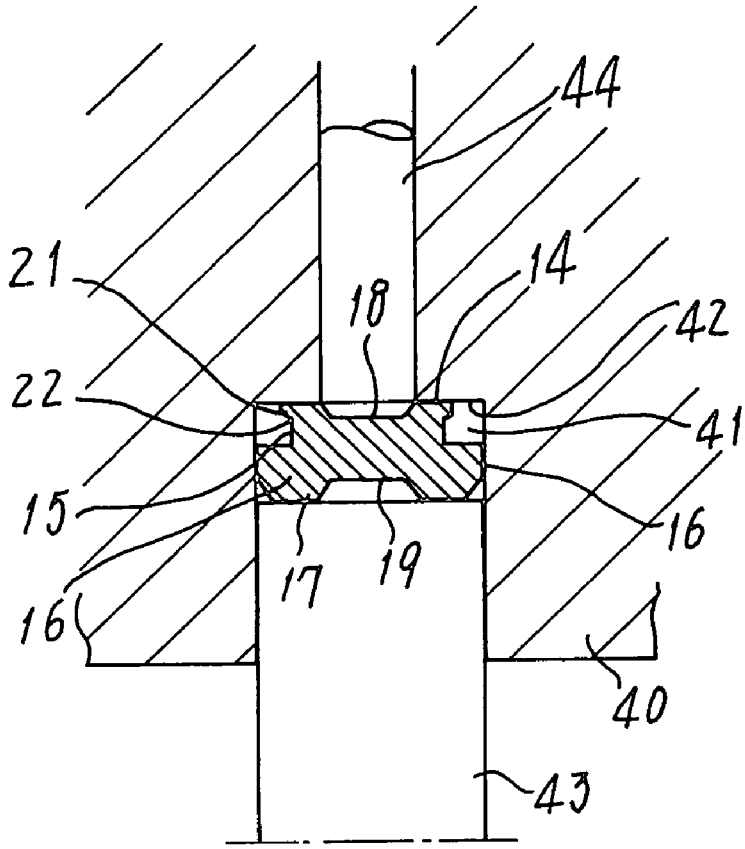
FIG. 4(*a*) is likewise a vertical cross section of the apparatus being used still further to subsequently form shoulders and lateral grooves in the pilot portion of nut blank.
Figure 4:
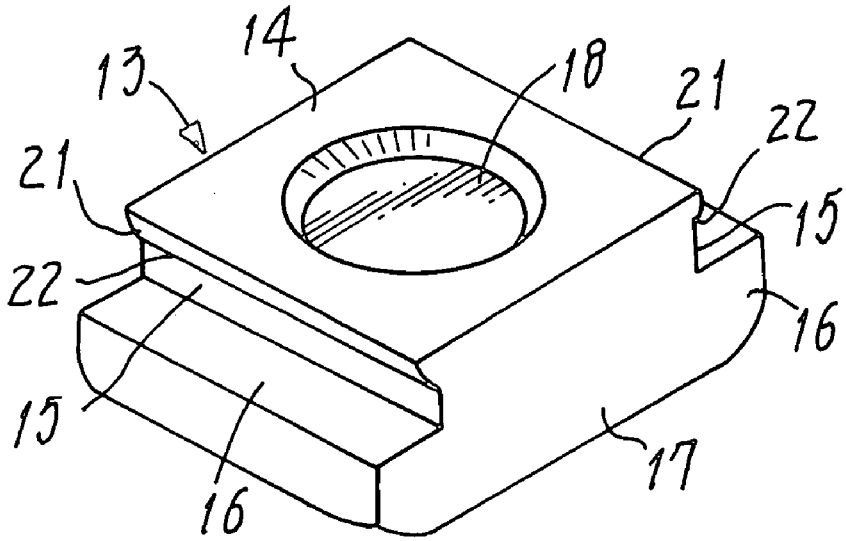

FIGS. 4(*a*) and 4(*b*) show the subsequent step of forming shoulders 21 and lateral grooves 22 in and along the side walls 15 of pilot portion 14, also in a swaging manner. In detail, the nut blank 13 having the two ridges 20 as just described above will be placed at first in an open cavity 41 of a still further die 40. Side walls of the flanges 16 are held in position inside this cavity while the pilot portion 14 of this blank is forced onto the ceiling 42 of said cavity 41. Then, the ridges 20 will be crushed sideways in opposite directions so as to form the shoulders 21 that are made integral with and in flush with the side wall upper ends of said portion 14. Each lateral groove 22 will thus appear between the shoulder 21 and the corresponding flange 16, in parallel with the middle height of each side wall 15 below the shoulder 21. The nut blank 13 semi-finished in this manner is ready to be finished to provide a complete self-piercing nut. The reference numeral 44 denotes a further knocking-out punch.

Figure 5:
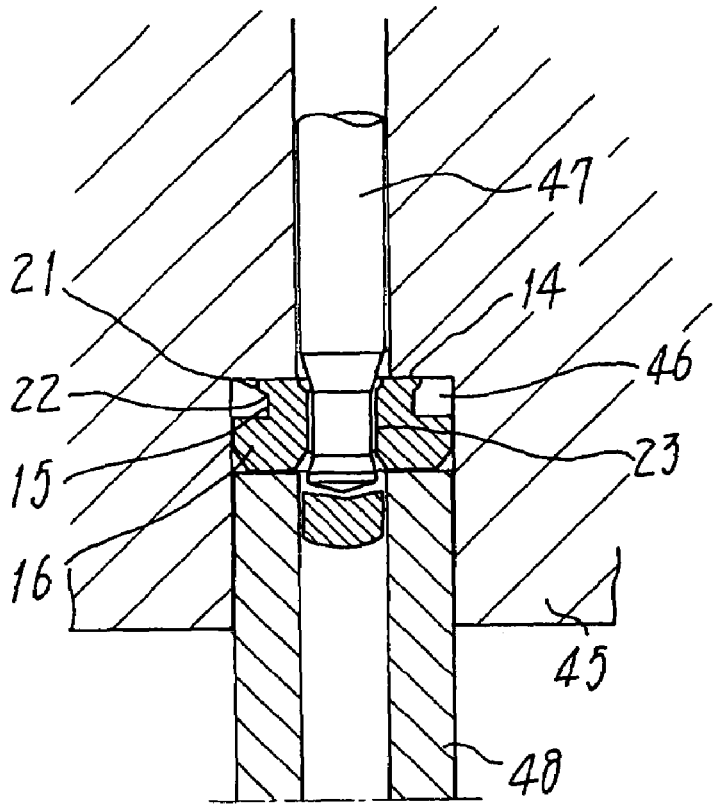
FIG. 5(*a*) is a vertical cross section of the apparatus being used yet still further to form a rough bore that is to be tapped thereafter to have a female thread.
Figure 5:
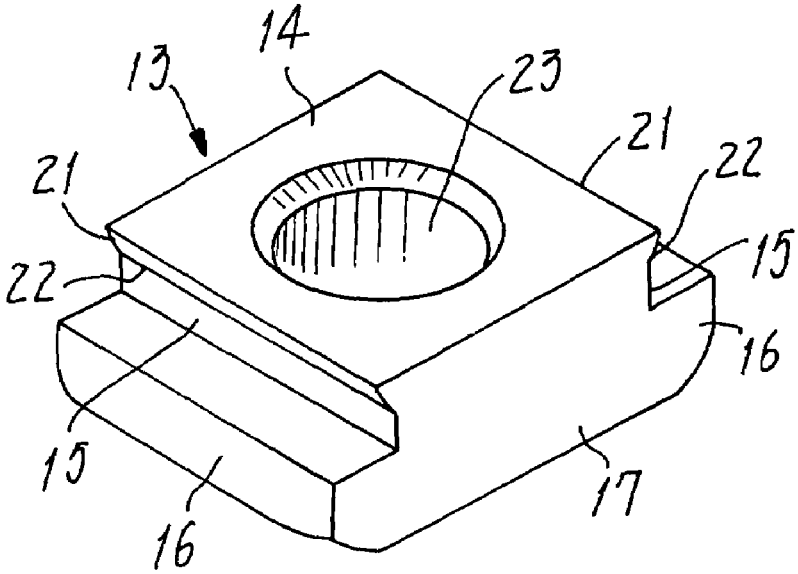

FIGS. 5(*a*) and 5(*b*) show the last-but-one step of boring a rough hole 23 in and through the nut blank 13 as delivered from the pressing step shown in FIGS. 4(*a*) and 4(*b*). This blank will be placed in another die 45 so that a striking punch 47 cooperates with an anvil 48 to form the axial unthreaded bore 23.

Figure 6:
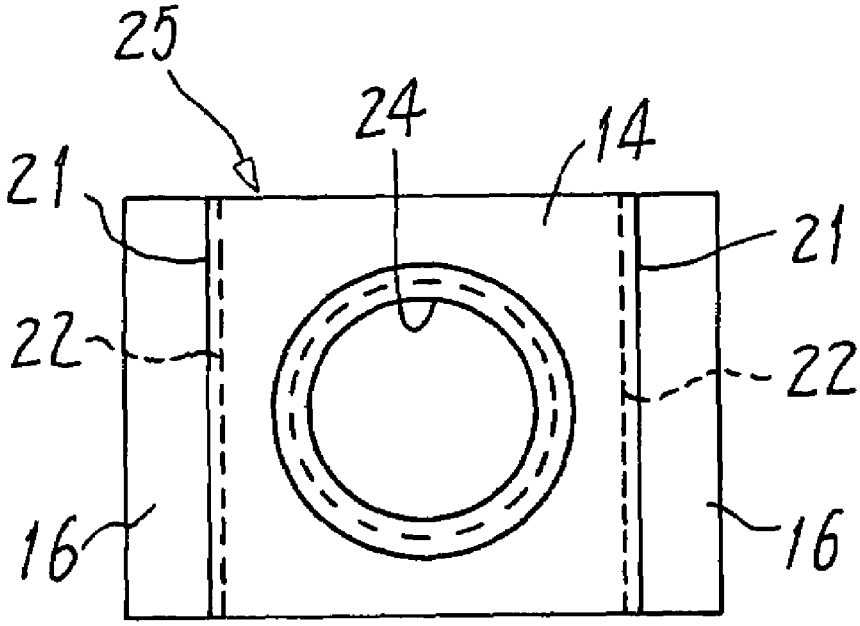
FIG. 6(*a*) is a plan view of a self-piercing nut that has finally been threaded and finished by the process of invention as shown in the preceding drawing figures.
Figure 6:
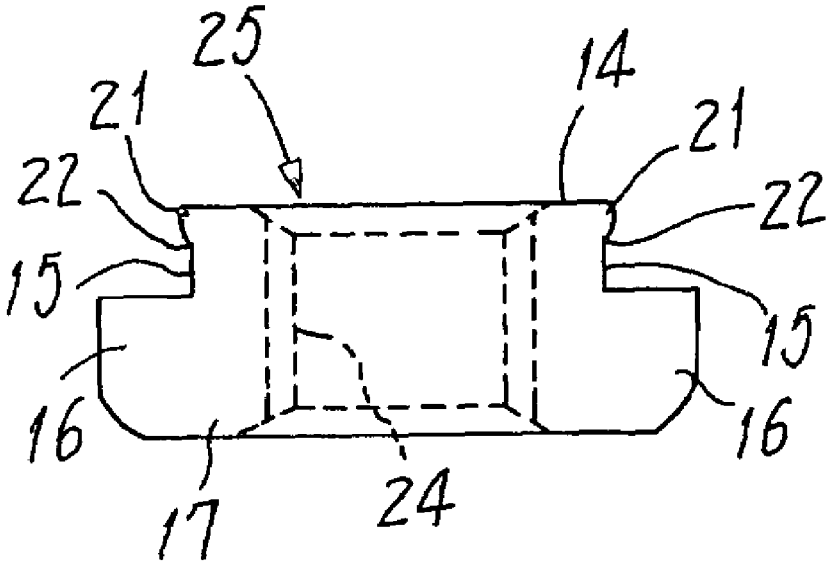

FIGS. 6(*a*) and 6(*b*) show a finished self-piercing nut 25 with a female thread 24 that is carved in and along the inner periphery of bore 23 formed at the previous step shown in FIGS. 5(*a*) and 5(*b*). Any tapping machine may be used to thread the axial bore.

Due to the repeating pressing steps applied to the blank of nut 25, the so-called effect of "work hardening" will have taken place therein. Such a hardened pilot portion 14 will surely have become strong enough to pierce an ordinary metal panel 10. The panel may possibly be composed of a metal of much higher toughness, such as a stainless steel or high-tensile steel. In this case, the pilot portion 14 may be reinforced by subjecting the self-piercing nut 25 wholly to a proper hardening treatment such as the carbon cementation process.

According to the present invention, the rectangular type self-piercing nuts can be manufactured using any ordinary nut-former on a large scale and at a lower cost, without needing any rolling and/or drawing process.

What is claimed is:

1. A method of making self-piercing nuts comprising the steps of:

firstly and preliminarily pressing into a closed mold a raw parallelepiped metal piece so as to provide a nut blank that has in an upper region thereof a generally square pilot portion with a generally square end face capable of piercing a metal panel, the nut blank having in a lower region thereof a pair of flanges that continue sideways from opposite side walls of the pilot portion;

secondly coining the nut blank to form a pair of ridges facing one another and extending along and integral with upper edges of the opposite side walls of the pilot portion;

thirdly pressing the nut blank within an open mold so that the pair of ridges are swaged sideways and outwards to form shoulders in such a fashion that a lateral groove is formed in each of the opposite side walls and intermediate between each shoulder and one of the flanges facing it;

fourthly boring a rough hole axially through the pilot portion;

and finally tapping a female thread in the inner periphery of the rough hole.

2. The method as defined in claim 1, wherein an upper recess as well as a lower recess are formed centrally of the nut blank and simultaneously with the step of coining the nut blank to form the ridges therein.

* * * * *